US009458841B2

(12) United States Patent
Tazume

(10) Patent No.: US 9,458,841 B2
(45) Date of Patent: Oct. 4, 2016

(54) OIL CIRCULATION SYSTEM FOR ELECTRIC MOTOR IN A HYBRID ELECTRIC VEHICLE

(71) Applicant: SUZUKI MOTOR CORPORATION, Shizuoka (JP)

(72) Inventor: Kunitoshi Tazume, Shizuoka (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 257 days.

(21) Appl. No.: 13/889,721

(22) Filed: May 8, 2013

(65) Prior Publication Data

US 2013/0323095 A1 Dec. 5, 2013

(30) Foreign Application Priority Data

Jun. 4, 2012 (JP) ..... 2012-127520

(51) Int. Cl.
*F04B 17/05* (2006.01)
*F04B 17/03* (2006.01)
(Continued)

(52) U.S. Cl.
CPC ..... *F04B 17/05* (2013.01); *F04B 17/03* (2013.01); *F04B 23/04* (2013.01); *F04B 49/065* (2013.01)

(58) Field of Classification Search
CPC ..... F04B 49/06; F04B 49/007; F04B 49/02; F04B 49/20; F04B 49/22; F04B 49/24; F04B 49/10; F04B 49/103; F04B 49/106; F04B 2205/14; F04B 2205/16; F04B 2205/09; F04B 2201/1201; F04B 2203/0209; F04B 2203/0214; F04B 39/02; F04B 39/0207; F04B 39/06; F04B 53/18; F04B 53/08; F04B 17/03; F04B 17/05; F04B 23/04; F04B 49/065; F16N 29/00; F16N 29/02; F16N 7/38; F16N 7/385; F01D 25/18
USPC ..... 184/6.1, 6.4
See application file for complete search history.

(56) References Cited

U.S. PATENT DOCUMENTS 4,928,500 A * 5/1990 Funahashi ..... F04B 49/02 62/129
7,976,419 B2 * 7/2011 Hartinger ..... G05D 7/0635 165/271

(Continued)

FOREIGN PATENT DOCUMENTS

CN 101761642 A 6/2010
CN 102463940 A 5/2012

(Continued)

OTHER PUBLICATIONS

CN 203717065 U—English Translation.*

(Continued)

*Primary Examiner* — Devon Kramer
*Assistant Examiner* — Christopher Brunjes
(74) *Attorney, Agent, or Firm* — Rothwell, Figg, Ernst & Manbeck, P.C.

(57) ABSTRACT

An oil circulation system for electric motors in a hybrid electric vehicle having, as a power source, an internal combustion engine is disclosed. Provision is made to start oil circulation under high reliability even though an electric pump cannot circulate lubricant oil through the electric motors due to increased viscosity at low temperatures. The oil circulation system includes the electric pump in fluid communication with an oil flow path for the electric motors; a mechanical pump, in fluid communication with the oil flow path, operable on driving power of the engine; and a controller for control of operation of the electric pump and that of the mechanical pump. The controller utilizes operation of the mechanical pump upon detection of abnormality in operation of the electric pump derived from viscosity of the lubricant oil in order to recover the electric pump.

5 Claims, 4 Drawing Sheets

(51) Int. Cl.
*F04B 23/04* (2006.01)
*F04B 49/06* (2006.01)

(56) References Cited

U.S. PATENT DOCUMENTS

| | | | | |
|---|---|---|---|---|
| 2003/0031971 | A1* | 2/2003 | Sugimoto | F23C 13/00 431/268 |
| 2003/0148850 | A1* | 8/2003 | Tomohiro | B60W 10/30 477/3 |
| 2008/0109129 | A1 | 5/2008 | Yanagida et al. | |
| 2010/0320019 | A1* | 12/2010 | Gale | B60K 6/445 180/65.27 |
| 2012/0141297 | A1* | 6/2012 | Jeong | B60K 6/48 417/5 |

FOREIGN PATENT DOCUMENTS

| | | | |
|---|---|---|---|
| CN | 203717065 | U * | 7/2014 |
| JP | 2003-97236 | A | 4/2003 |
| JP | 2006-132342 | A | 5/2006 |
| JP | 2006-254616 | A | 9/2006 |
| JP | 2010-195313 | A | 9/2010 |
| JP | 2012-34526 | A | 2/2012 |

OTHER PUBLICATIONS

The First Office Action mailed Feb. 2, 2015 in corresponding Chinese Patent Application No. 201310186312.1 (with an English translation) (16 pages).
The Second Office Action mailed Oct. 10, 2015 in corresponding Chinese Patent Application No. 201310186312.1 (with an English translation) (6 pages).

* cited by examiner

OIL CIRCULATION SYSTEM FOR ELECTRIC MOTOR IN A HYBRID ELECTRIC VEHICLE

CROSS REFERENCE TO RELATED APPLICATION

The present application claims priority to Japanese Patent Application No. 2012-127520, filed on Jun. 4, 2012, the entire contents of which are hereby incorporated by reference for all purposes.

TECHNICAL FIELD

The present invention relates to an oil circulation system for electric motor in a hybrid electric vehicle, more specifically for securing sufficient supply of oil necessary for operation of the electric motor.

BACKGROUND

It is common practice for an electric motor to use lubricant oil in order to provide a smooth rotational drive. Causing the lubricant oil to function as cooling oil by circulating the same through an oil flow path extending around the electric motor, the electric motor may operate efficiently by cooling heat generated during the rotational drive. A heat exchanger may be disposed in the oil flow path on the way or different cooling oil may be circulated. For example, JP-A 2006-254616 discloses a cooling system by circulating cooling oil. This oil circulation system for electric motors has implemented a pump start-up procedure to definitely start an electric oil pump by repeating start-up operation more than once in the event that the electric oil pump fails to start circulating cooling oil for some reason.

However, the oil circulation system for electric motors disclosed by JP-A 2006-254616 poses a problem that its cooling function will not work unless the start-up of the electric oil pump succeeds because the cooling oil cannot be made to circulate until the start-up of the electric oil pump succeeds. If the oil circulation system for electric motors disclosed by JP-A 2006-254616 were applied to circulation of lubricant oil for the electric motors, lubrication property might become insufficient due to the shortage of lubricant oil supply to sliding parts of the electric motors.

SUMMARY

Accordingly, an object of the present invention is to provide an oil circulation system for an electric motor in a hybrid electric vehicle, which can provide oil circulation under high reliability to sliding parts of the electric motor even though an electric pump fails to start.

According to a first aspect (1) of the present invention, there is provided a lubricant oil circulation system for circulation of lubricant oil of an electric motor in a hybrid electric vehicle that is powered by and has, as power sources, the electric motor operable on electric power supplied from an electrical storage device and an internal combustion engine, comprising: an electric pump operable on electric power stored in the electrical storage device to circulate the lubricant oil in an oil flow path that includes the electric motor interior structure; a mechanical pump operable on driving power of the internal combustion engine to circulate the lubricant oil in the oil flow path; and a controller configured to detect abnormality in operation of the electric pump derived from viscosity of the lubricant oil and to use operation of the mechanical pump on driving power of the internal combustion engine upon detecting the abnormality in operation of the electric pump.

According to a second aspect (2) of the present invention, the mechanical pump is made to have such a structure as to receive the amount of heat from the internal combustion engine.

According to a third aspect (3) of the present invention, the controller causes the mechanical pump to keep on operating for a predetermined duration of time immediately after detecting that the abnormality of the mechanical pump has been eliminated and shuts down the mechanical pump upon lapse of the predetermined period of time.

According to a fourth aspect (4) of the present invention, the controller adjusts rotational speed of the mechanical pump in response to rotational speed of the electric pump after the electric pump has started so that flow rate of the lubricant oil remains lower than a predetermined flow rate.

According to a fifth aspect (5) of the present invention, the system further comprises: an oil cooler in the oil flow path; a detour around the oil cooler and a flow path switching valve for switching between the oil cooler and the detour, and the controller executes switching control of the flow path switching control valve so that the lubricant oil passes through the detour around the oil cooler upon detecting the abnormality in operation of the electric pump.

According to a sixth aspect (6) of the present invention, the hybrid electric vehicle is operable in a drive mode in which only the electric motor powers the vehicle or in another drive mode in which at least the internal combustion engine powers the vehicle, and the controller prohibits the vehicle operation in the drive mode in which only the electric motor powers the vehicle, but allows the vehicle operation in another drive mode in which at least the internal combustion engine powers the vehicle upon detecting the abnormality in operation of the electric pump.

According to the above-mentioned first aspect (1) of the present invention, the mechanical pump operable on driving power from the internal combustion engine is used upon detecting the abnormality in operation of the electric pump, for circulation of lubricant oil through the electric motor (s) in the hybrid electric vehicle, derived from viscosity of the lubricant oil. Therefore, it is possible to maintain efficient rotational operation of the electric motor by avoiding insufficient lubrication of the sliding parts of the electric motor caused due to shortage supply of oil.

According to the above-mentioned second aspect (2), it is possible to heat the lubricant oil circulated by the mechanical pump by utilizing the amount of heat of the internal combustion engine. Thus, in the event that, for example, there is abnormality of the electric pump derived from viscosity anomaly caused by low temperatures of lubricant oil, the viscosity maybe adjusted appropriately by increasing the temperature of lubricant oil.

According to the above-mentioned third aspect (3) of the present invention, even though the electric pump is not recovered to its stable operation upon elimination of the abnormality, the electric pump may be recovered to its stable state immediately after maintaining operation of the mechanical pump for a predetermined duration of time. It follows that the worst case scenario that circulation of lubricant oil is still insufficient because the electric pump does not attain its stable operation state when the mechanical pump is shutdown upon elimination of abnormality of the electric pump may be avoided and lubricant oil may be circulated under high reliability.

According to the above-mentioned fourth aspect (4) of the present invention, the flow rate of lubricant oil may be restrained lower than a predetermined flow rate by adjusting rotational speeds of the electric pump and mechanical pump. It follows that the worst case scenario that the durability of the oil flow path may be reduced as the flow rate of lubricant oil exceeds a setting level of pressure resistance of the oil flow path may be avoided. In addition, the worst case scenario that heat exchange becomes ineffective if the lubricant oil serves as cooling oil may be avoided.

According to the above-mentioned fifth aspect (5) of the present invention, the flow path of lubricant oil may be changed from the oil cooler to the detour upon occurrence of abnormality of the electric pump derived from viscosity of lubricant oil. This abnormality may be eliminated without any delay by the amount of heat of the internal combustion engine because the worst case scenario that the lubricant oil is further cooled down by the oil cooler when there is the viscosity anomaly due to excessive low temperature is avoided.

According to the above-mentioned sixth aspect (6) of the present invention, the hybrid electric vehicle is not powered by only the electric motor(s), but by at least the internal combustion engine. Therefore, circulating lubricant oil by the mechanical pump of the internal combustion engine, the electric motor(s) may operate to drive the vehicle, and only the internal combustion engine drives the vehicle until the electric pump will be recovered (the elimination of abnormality), so that a shift to the drive mode in which only the electric motor(s) drive the vehicle may be made without delay.

DETAILED DESCRIPTION

Referring to the accompanying drawings, an embodiment of the present invention is described. FIGS. 1 to 4 depict an example hybrid electric vehicle with one embodiment of an oil circulation system for electric motors according to the present invention.

Figure 1:
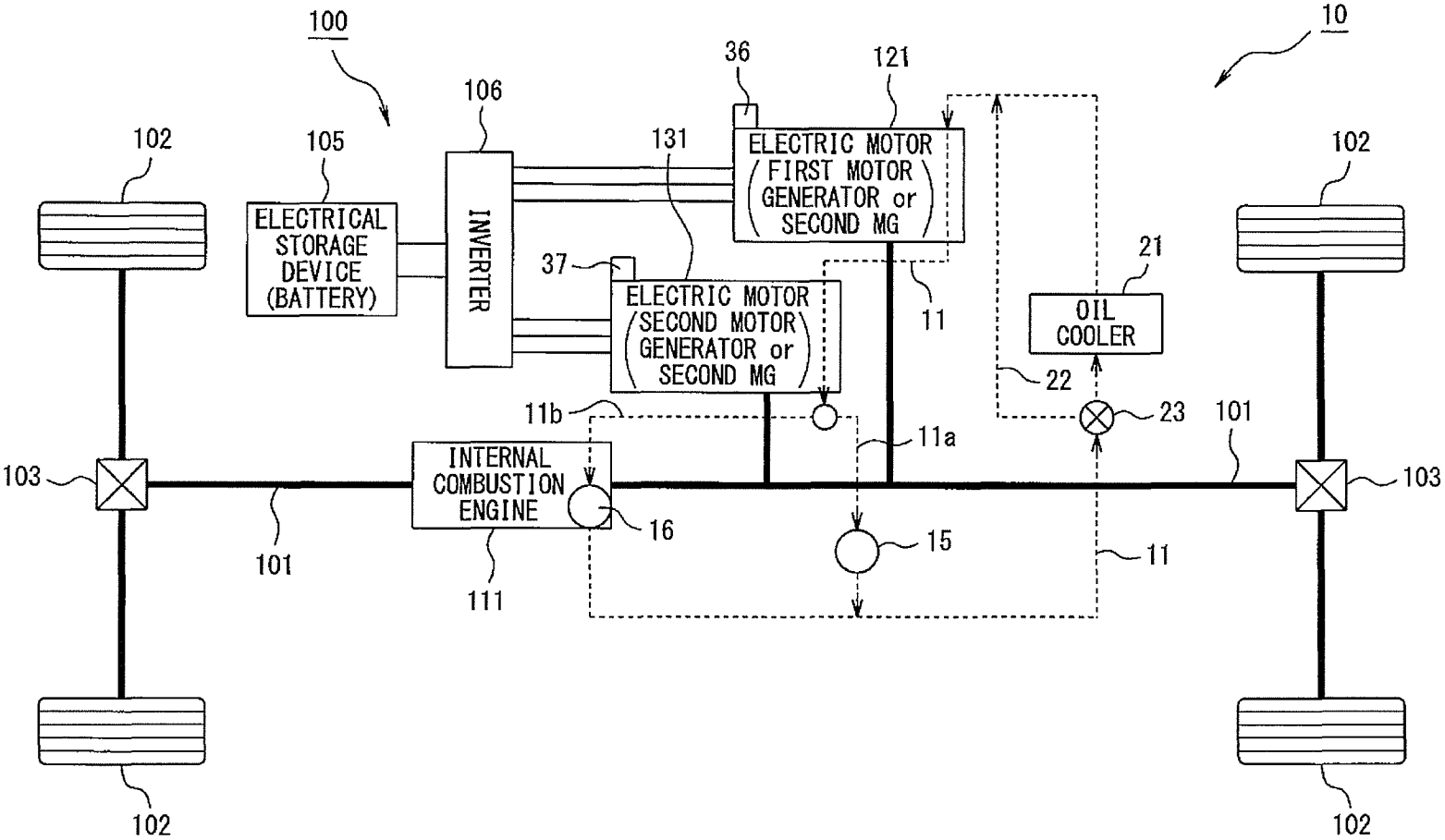
FIG. 1 is a diagram showing one embodiment of an oil circulation system for electric motors in a hybrid electric vehicle according to the present invention, specifically a system configuration diagram showing an outline of the overall structure of the system.

Referring to FIG. 1, the hybrid electric vehicle, now denoted at 100, includes, as power sources, an internal combustion engine 111, a first electric motor or first motor generator (first MG) 121 and a second electric motor or second motor generator (second MG) 131. Hybrid electric vehicle 100 is driven by activating engine 111, first MG 121 and second MG 131 as appropriate to deliver power to drive shafts 101, each coupled to one of a set of traction wheels 102 via a differential 103. Engine 111, which is configured to generate driving power resulting from combustion of gasoline for the purpose of delivering drive torque to cause drive shafts to turn, may yield any desired level of driving power at low environmental temperatures while it is warming up. First and second electric motors 121 and 131 operate upon receiving electrical power stored in an electrical storage device 105 (battery) like on board electrical components; and one or both of first and second electric motors 121 and 131 may be made to operate to store electrical storage device 105 with regenerative energy that may be generated during deceleration and driving downhill. First and second electric motors 121 and 131 are coupled to electrical storage device 105 that has a negative wire and a positive wire for storing direct power dc via a DC/AC inverter 106 because they operate on three-phase alternating power.

First and second electric motors 121 and 131 are incorporated in an oil circulation system 10 which may provide not only a benefit of lubricating rotor shafts and other sliding parts by circulating lubricant oil through each of them along an oil flow path 11, but also a benefit of achieving a cooling effect by taking out heat following the rotational movement of the rotor shafts outside and cooling it down by heat transfer.

Oil circulation system 10 is configured to circulate lubricant oil by providing an electric pump 15 in oil flow path 11 at a location on the way to the electric motors with respect to the direction of flow of lubricant oil and it has an oil cooler 21 with a heat exchanger like a heat sink disposed downstream of electric pump 15. This enables the oil circulation system 10 to ensure efficient operation of first and second electric motors 121 and 131 by lowering the level of heat following the rotational movement of rotor shafts because of circulating lubricant oil as coolant oil and effectively cooling down the lubricant oil at oil cooler 21.

Further, engine 111 may operate without delivering any driving power to drive shafts 101 so that first and second electric motors 121 and 131 operate as generators to charge electrical storage device 105. In addition to a mechanical pump to circulate coolant through a radiator to cool down engine 111, a mechanical pump 16 is prepared as a pump to maintain circulation of lubricant oil through first and second electric motors 121 and 131.

Oil flow path 11 bifurcates at a portion downstream of first and second electric motors 121 and 131 so that two bifurcated paths 11*a* and 11*b* communicate with electric pump 15 and mechanical pump 16, respectively. These bifurcated paths 11*a* and 11*b* each may be provided with a control valve or a detour as appropriate, which opens or closes in response to pattern of operation of electric pump 15 and mechanical pump 16 to prevent lubricant oil from passing through the deactivated pump, but there is no need to provide such control valve or detour in the event that the passage of lubricant oil does not pose any problem to the deactivated pump. This oil flow path 11 has a detour 22 arranged in parallel to an oil cooler 21 and a control valve 23 configured to switch between the passage of lubricant oil through the detour 22 and the passage of lubricant oil through oil cooler 21. Control valve 23 is activated by a controller 31 shown in FIG. 2 to select the passage through oil cooler 21 or the passage through detour 22, causing lubricant oil to circulate through the selected passage.

Figure 2:
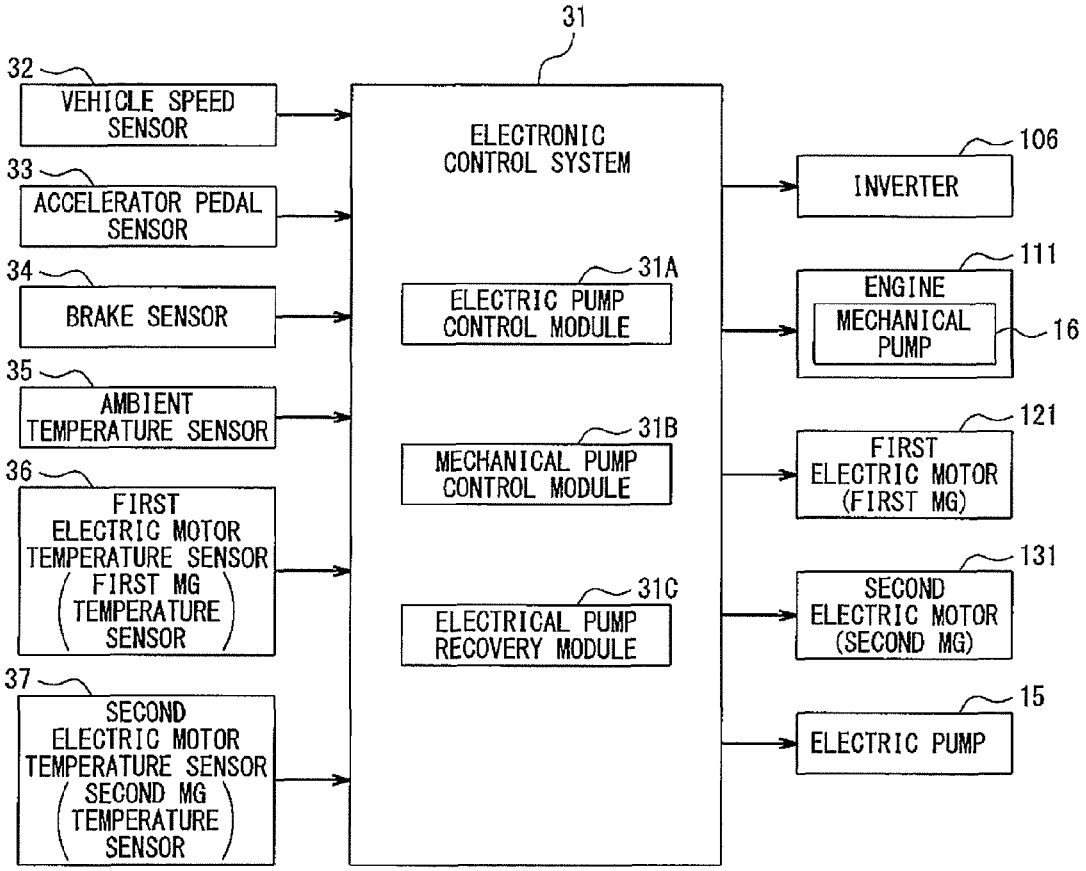
FIG. 2 is a block diagram showing the control configuration, illustrating the oil circulation control strategy.

Referring to FIG. 2, controller 31 includes a CPU, a memory and other components and executes control program (s) stored beforehand so that it is created as an electronic control system to perform integrated control of multiple units of hybrid electric vehicle 100 as a whole. Controller 31 achieves travelling of hybrid electric vehicle 100 by performing integrated control of multiple units like inverter 106, engine 111, first and second electric motors 121 and 131 based on various kinds of sensor information from a vehicle speed sensor 32, an accelerator pedal sensor 33 and a brake sensor 34 and predetermined parameter information.

Specifically, controller 31 may be created to achieve a control for a so-called parallel-type hybrid electric vehicle by performing a switching control between an EV (Electric Vehicle) mode, in which the vehicle is powered by only first electric motor 121 and/or second electric motor 131, and a HEV (Hybrid Electric Vehicle) mode, in which the vehicle is powered by using, in combination, engine 111 and first and second electric motors 121 and 131. This means that controller 31 constitutes a driving controller. Further, a drive mode in which the vehicle is powered only by engine 111 may be provided. Controller 31 may be created to achieve a control for a so-called series-type hybrid electric vehicle in which use of engine 111 is confined to storage of electricity. Furthermore, in addition to performing integrated control of hybrid electric vehicle 100, controller 31 according to the present embodiment has an ambient temperature sensor 35, a first electric motor temperature sensor 36 and a second electric motor temperature sensor 37 in order to serve as a pump control and a detection of abnormal state. It also has a speed detection sensor used for detection of rotational speed of each of mechanical pump 16 and electric pump 15 (a detection of rotational speed) for purpose of using engine 111 and electric motors 121 and 131 when driving in EV mode is prohibited, which is described later. This controller 31 serves as an electric pump control module 31A, a mechanical pump control module 31B and a recovery module of electric pump 31C, which perform control of activation or recovery of electric pump 15 together with control of inverter 106, engine 111 (including mechanical pump 16), first electric motor 121 and second electric motor 131 based on the various kinds of sensor information.

Figure 3:
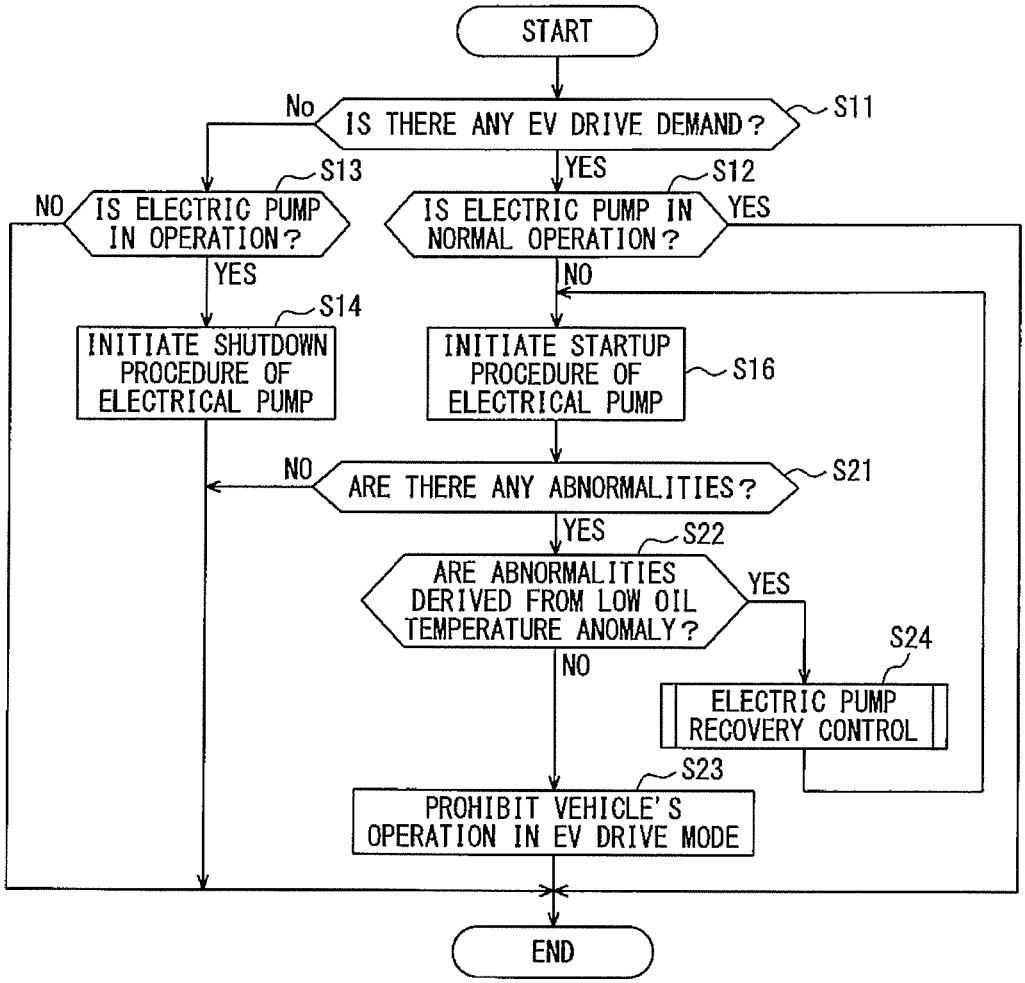
FIG. 3 is a flow chart depicting an oil circulation control strategy.
Figure 4:
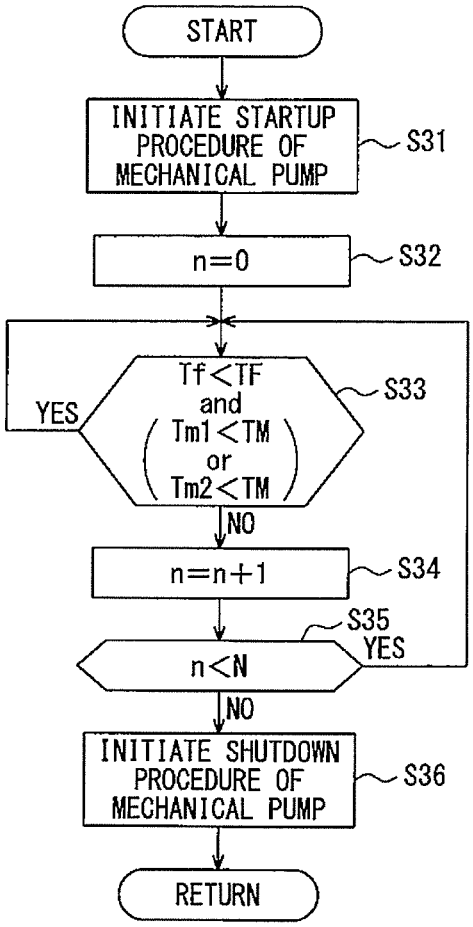
FIG. 4 is a flow chart depicting a subroutine of a recovery control strategy during the oil circulation control strategy.

For more information, controller 31 executes a control routine (a method) depicted by flow charts shown in FIGS. 3 and 4 based on the above-mentioned control program in order to operate electric pump 15 without fail even at low temperatures, for example, in a cold area for early initiation of driving in electric vehicle (EV) drive mode by operation of first and second electric motors 121 and 131

Referring to FIG. 3, at step S11, controller 31 determines whether or not there is a demand for an EV drive due to a select input of the driver or a select command of an automatic switching control, and if there is the demand for the EV drive mode (Y), the routine proceeds to step S12, while if the demand is not ascertained (N), the routine proceeds to step S13. At step S12, it is determined whether or not electric pump 15 is in normal operation, and if it is in normal operation (Y), the routine is closed, while if it is not in normal operation (N), the routine proceeds to step S16 in which a startup procedure of electric pump 15 is initiated and then to step S21. Meanwhile, at step S13, it is determined whether or not electric pump 15 is in operation, and if it is not in operation (N), the routine is closed, while if it is in operation even though there is no demand for EV drive (Y), the routine proceeds to step S14 in which a shutdown procedure of electric pump 15 is initiated and then this routine is closed.

At step S21, it is determined whether or not there are any abnormalities such as the event that electric pump 15 fails to start even though the startup procedure of electric pump 15 at step S16 is completed, and if there are no abnormalities so it is in normal operation (Y), the routine is closed, while if there are abnormalities in operation (Y), the routine proceeds to step S22. At step S22, if the apparatus temperatures (lubricant oil temperatures) Tm1 and Tm2 which are detected by first and second electric motor temperature sensors 36 and 37 are not lower than an operating limit temperature TM (e.g. 0° C.) and so the abnormalities are not derived from low temperature anomaly (N), the routine proceeds to step S23, while if the abnormalities are derived from low temperature anomaly (Y), the routine proceeds to step S24.

At step S23, vehicle's operation in EV drive mode is prohibited and the routine is closed. In this case, engine 111 and first and second electric motors 121 and 131 are used as power sources and their output torques are composed by a drive unit, not illustrated, to rotate drive shafts 101. This may avoid damage to electric pump 15 caused when the vehicle is forced to operate in EV drive mode. Then, detecting rotational speeds of mechanical pump 16 and electric pump 15, controller 31 may cause electric pump 15 to operate at a speed variable in response to viscosity of lubricant oil together with mechanical pump 16. In this case, rotational speed of mechanical pump 16 and that of electric pump 15 are balanced and adjusted so that flow speed of lubricant oil does not exceed a setting range within which electric motors 121 and 131 are lubricated and cooled down effectively. It goes without saying that only engine 111 may operate as a source of power when vehicle's operation in EV drive mode is prohibited at step S23.

After executing, at step S24, a recovery control procedure of electric pump 15 described later, the routine returns to step S16 in which the startup procedure of electric pump 15 is repeated. Also in this case, controller 31 uses first and second electric motors 121 and 131 as power sources together with engine 111 that is activated during the recovery control procedure of electric pump 15 described later.

In short, controller 31 executes the recovery control procedure of electric pump (step S24) in the event that there is abnormality in which electric pump 15 fails to operate because lubricant oil cannot flow with viscosity maintained at a desired level when at least one of apparatus temperatures Tm1 and Tm2 of first and second electric motors 121 and 131 is lower than the operating limit temperature TM (steps S11, S12, S16 and S21). During the recovery control procedure of electric pump 15, the amount of heat generated by operations of engine 111 and first and second electric motors 121 and 131 per se may raise lubricant oil toward a desired temperature level. If the current abnormality is derived from low temperature of lubricant oil, this prevents abnormality from occurring and being ascertained (steps S21 and S22) when the startup procedure of electric pump 15 is executed again at step S16. Therefore, immediately after completion of this recovery control procedure, electric pump 15 is enabled to circulate lubricant oil at a proper rate, causing first and second electric motors 121 and 131 to operate normally.

Referring, now, to FIG. 4, during the recovery control procedure of electric pump 15 at step S24, controller 31 repeats checking warming-up of lubricant oil (step S33) after executing a start-up procedure of mechanical pump 16 or engine 111 (step S31) and resetting a timer counter n (n=0). In this situation, controller 31 executes switching control of control valve 23 so that lubricant oil flows through detour 22 around oil cooler 21. This means that controller 31 serves as a flow path switching module, too, avoiding cooling down of circulating lubricant oil, making it possible to appropriately adjust viscosity by effectively raising temperature of lubricant oil. During checking warming-up of lubricant oil at step S33, the process of checking that ambient temperature Tf detected by ambient temperature sensor 35 is lower than an operating limit temperature TF (e.g. 0° C.) and so lies in a low temperature environment and at least one of apparatus temperatures Tm1 and Tm2 detected by first and second electric motor temperature sensors 36 and 37 are lower than the operating limit temperature TM (e.g. 0° C.) is repeated. At step S33, it is determined that electric pump 15 is in its recovery state and ready for operation in the event that ambient temperature Tf is greater than or equal to the operating limit temperature TF and thus electric pump 15 lies within operating temperature range or in the event that the apparatus temperatures Tm1 and Tm2 both are greater than or equal to the operating limit temperature TM.

Immediately after determining that electric pump 15 is in the recovery state at step S33, the routine returns to step S33 to repeat the same process until timer counter n achieves a predetermined duration of operation N (e.g. 60 seconds) after incrementing n (n=n+1) at step S34. After causing mechanical pump 16 to continue its operation for the predetermined duration of operation N upon completion of warming-up (step S35), the shutdown procedure of mechanical pump 16 is executed at step S36 before the routine returns to step S16 shown in FIG. 3.

This enables controller 31 to cause first and second electric motors 121 and 131 to operate with circulation of lubricant oil maintained without forcing electric pump 15 to operate because of operation of mechanical pump 16 initiated by startup of engine 111. Thus, lubricating oil is subject to a rise in temperature upon receiving the amount of heat generated during operations of engine 111 and first and second electric motors 121 and 131, making it possible to adjust to such appropriate viscosity as to permit lubricant oil to flow through electric pump 15. Further, first and second electric motors 121 and 131 may operate smoothly with circulation of sufficient amount of lubricant oil caused due to sufficient warming-up because entry into unstable single circulation initiated by shutdown of mechanical pump immediately after electric pump 16 has entered but the very limit of the operation limit temperature range.

In this manner, according to the present embodiment, in the event that electric pump 15 trips (abnormal shutdown) due to high viscosity of lubricant oil at low temperatures, it is possible to force lubricant oil to circulate through first and second electric motors 121 and 131 by using mechanical pump 16 of engine 111. Thus, it is possible for the lubricant oil to utilize heat from engine 111 for heating itself because it is circulated and it is possible to restore viscosity of lubricant oil to the appropriate viscosity level by avoiding insufficient lubrication which might otherwise take place due to shortage of oil at sliding parts like rotor shafts of first and second electric motors 121 and 131. Therefore, without any damage to electric pump 15, lubricant oil is recovered quickly to the appropriate level of viscosity so that only electric pump 15 may circulate the lubricant oil, making it possible for the vehicle to operate in EV drive mode without any delay.

The present invention is not limited to the exemplary embodiment described and illustrated, but it encompasses all of embodiments which provide equivalent effects to what the present invention aims at. Further, the present invention is not limited to combinations of features of the subject matter defined by every claim, but it is defined by all of any desired combinations of specific ones of all of disclosed features.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through prosecution of new claims in this or a related application. Such claims, whether broader, narrower, equal, or different in scope to the original claims, also be regarded as included within the subject matter of the present disclosure.

10 Oil circulation system, 11 Lubricant oil flow circuit, 11*a*, 11*b* Branch flow paths, 15 Electric pump, 16 Mechanical pump, 21 Oil cooler, 22 Detour, 23 Control valve, 31 Controller, 35 Ambient temperature sensor, 36, 37 Electric motor temperature sensors, 100 Hybrid electric vehicle, 105 Electrical storage device, 106 Inverter, 111 Engine, and 121, 131 Electric motors.

The invention claimed is:

1. A lubricant oil circulation system for circulation of lubricant oil of an electric motor in a hybrid electric vehicle that is powered by and has, as power sources, the electric motor operable on electric power supplied from an electrical storage device and an internal combustion engine, comprising:

an electric pump operable on electric power stored in the electrical storage device to circulate the lubricant oil in an oil flow path that includes the electric motor interior structure;

a mechanical pump operable on driving power of the internal combustion engine to circulate the lubricant oil in the oil flow path; and a controller configured to detect abnormality in operation of the electric pump derived from viscosity of the lubricant oil and to activate the mechanical pump for using operation of the mechanical pump on driving power of the internal combustion engine upon detecting the abnormality in operation of the electric pump, wherein the controller is configured to detect elimination of the abnormality in operation of the electric pump derived from viscosity of the lubricant oil and the controller controls the mechanical pump to continue operating for a predetermined duration of time, which begins immediately after detecting elimination of the abnormality of the electric pump derived from viscosity of the lubricant oil, and wherein the controller compares an amount of time after detecting elimination of the abnormality of the electric pump derived from viscosity of the lubricant oil with the predetermined duration of time and the controller shuts down the mechanical pump upon lapse of the predetermined duration of time.

2. The oil circulation system according to claim 1, wherein, when the mechanical pump continues operating for the predetermined duration of time until the mechanical pump is shut down upon lapse of the predetermined duration of time, the controller adjusts rotational speed of the mechanical pump in response to rotational speed of the electric pump after the electric pump has started so that flow rate of the lubricant oil remains lower than a predetermined flow rate.

3. The oil circulation system according to claim 1, further comprising: an oil cooler in the oil flow path; a detour around the oil cooler and a flow path switching valve for switching between the oil cooler and the detour, and wherein the controller executes switching control of the flow path switching control valve so that the lubricant oil passes through the detour around the oil cooler upon detecting the abnormality in operation of the electric pump.

4. The oil circulation system according to claim 1, wherein the hybrid electric vehicle is operable in a drive mode in which only the electric motor powers the vehicle or in another drive mode in which at least the internal combustion engine powers the vehicle, and the controller prevents the vehicle from operating with only the electric motor and allows the vehicle to operate with at least the internal combustion engine when the abnormality of the electric pump is detected.

5. The oil circulation system according to claim 1, wherein the electric pump is in fluid communication with the oil flow path and the mechanical pump is in fluid communication with the oil flow path, and the mechanical pump is drivably connected to the internal combustion engine.

* * * * *